US007015877B2

(12) United States Patent
Lei et al.

(10) Patent No.: US 7,015,877 B2
(45) Date of Patent: Mar. 21, 2006

(54) MULTI-COLOR SEGMENTED DISPLAY

(75) Inventors: Luiz Lei, N.T. (HK); Chi Biu Gorden Wong, Kowloon (HK)

(73) Assignee: Litech Electronic Products Limited, Kwai Chung (HK)

( * ) Notice: Subject to any disclaimer, the term of this patent is extended or adjusted under 35 U.S.C. 154(b) by 0 days.

(21) Appl. No.: 10/881,702

(22) Filed: Jun. 30, 2004

(65) Prior Publication Data

US 2006/0001598 A1 Jan. 5, 2006

(51) Int. Cl.
*G09G 3/14* (2006.01)

(52) U.S. Cl. ..... 345/39; 345/40; 345/35; 345/34; 340/815.44; 340/815.15

(58) Field of Classification Search ..... 340/815.44, 340/815.45; 345/34, 39, 35, 46
See application file for complete search history.

(56) References Cited

U.S. PATENT DOCUMENTS

| | | | | |
|---|---|---|---|---|
| 3,481,062 | A | 12/1969 | DuBois, Jr. et al. | |
| 3,740,570 | A | 6/1973 | Xaelin et al. | |
| 3,840,873 | A | 10/1974 | Usui | |
| 3,924,227 | A | 12/1975 | Stolov | |
| 4,086,514 | A | 4/1978 | Havel | |
| 4,271,408 | A * | 6/1981 | Teshima et al. | 345/83 |
| 4,395,654 | A * | 7/1983 | Hattori et al. | 313/496 |
| 4,488,149 | A | 12/1984 | Givens, Jr. | |
| 4,647,217 | A | 3/1987 | Havel | |
| 4,724,629 | A | 2/1988 | Walton | |
| 4,845,481 | A | 7/1989 | Havel | |
| 4,870,325 | A | 9/1989 | Kazar | |
| 5,008,595 | A | 4/1991 | Kazar | |
| 5,487,053 | A * | 1/1996 | Beiswenger et al. | 368/69 |
| 5,812,102 | A * | 9/1998 | Sprole et al. | 345/34 |
| 6,018,237 | A | 1/2000 | Havel | |
| 6,097,367 | A | 8/2000 | Kuriwaki et al. | |
| 6,239,776 | B1 | 5/2001 | Havel | |
| 6,288,696 | B1 | 9/2001 | Holloman | |
| 6,431,719 | B1 | 8/2002 | Lau et al. | |
| 6,588,132 | B1 | 7/2003 | Tsuji | |
| 6,599,033 | B1 | 7/2003 | Phnke | |
| 6,628,249 | B1 | 9/2003 | Kamikawa et al. | |
| 6,639,574 | B1 | 10/2003 | Scheibe | |
| 6,829,852 | B1 * | 12/2004 | Uehran | 40/451 |
| 2003/0095082 | A1 * | 5/2003 | Kamei et al. | 345/39 |

FOREIGN PATENT DOCUMENTS

| | | | |
|---|---|---|---|
| DE | 3037500 | A1 | 4/1981 |
| DE | 3009416 | A1 | 9/1981 |
| DE | 220884 | A1 | 4/1985 |
| GB | 2158631 | A | 11/1985 |

* cited by examiner

*Primary Examiner*—Tuyet Thi Vo
(74) *Attorney, Agent, or Firm*—Brooks Kushman P.C.

(57) ABSTRACT

A multi-color segmented LED or other light emitting arrangement display includes specially designed segments such that there are two or more rooms within one segment. When one or more LEDs or light emitting arrangements with different colors are placed in each room of a segment, the segment will generate a very special light effect—a multi-colored segment. In one aspect, it is possible to control the height of the wall between rooms such that a mixed color light effect is produced between the adjacent rooms. The multi-color segmented display can be used in a variety of applications.

11 Claims, 3 Drawing Sheets

MULTI-COLOR SEGMENTED DISPLAY

BACKGROUND OF THE INVENTION

1. Field of the Invention

The invention relates to segmented light emitting diode (LED) displays wherein displayed letters, numbers, etc. are composed of illuminated segments. The illuminated segments produce a simple display that indicates the current time or other information.

2. Background Art

A typical segmented display includes a plurality of segments. The segments are controlled on an individual basis to allow selective illumination of segments on the display to provide any desired illumination pattern composed of illuminated segments.

In the traditional LED display, each illuminated segment is illustrated by one or more light emitting diodes (LEDs) placed within the same room. In the traditional LED display, there is only one room in each segment, which means that each segment can have only one color.

Background information may be found in U.S. Pat. Nos. 4,870,325; 4,845,481; 5,008,595; 6,018,237; and 6,239,776.

For the foregoing reasons, there is a need for an improved multi-color segmented display.

SUMMARY OF THE INVENTION

It is, therefore, an object of the invention to provide an improved multi-color segmented display.

The invention comprehends a multi-color segmented LED display. The segments of the LED display are specially designed such that there are two or more rooms within one segment. When one or more LEDs with different colors are placed in each room of a segment, the segment will generate a very special light effect—a multi-colored segment.

The invention, in one aspect, uses one or several walls to divide the LED segment into two or more small rooms or partitions. Each room or partition is then filled with one or more LEDs with different colors. This approach provides two or several colors within one segment. And by controlling the height of the walls, a mixed color light effect between the adjacent rooms is produced. Also, the wall can be any kind of material—for example, plastic, metal, paper, fiberglass, PCB, etc. Also, the wall can be of any shape and can be placed anywhere within the segment. Further, the LEDs can be placed anywhere within the rooms.

This multi-color segmented LED display can be used in a variety of applications including, for example, simple LED alarm clocks, LED alarm clock radios, LED alarm clock timers, LED alarm clocks with thermometer, humidity, etc. Other applications that could use the LED display panel to display a message include an air conditioner, evaluator, instruments, or any home appliances such as oven, coffee maker, etc.

It is appreciated that the display may utilize other light emitting device arrangements in combination with or in alternative to LEDs. It is further appreciated that the rooms or partitions within a segment may be arranged in a variety of ways, with one or more dividing walls. Several embodiments are contemplated.

DETAILED DESCRIPTION OF THE PREFERRED EMBODIMENTS

Figure 1:
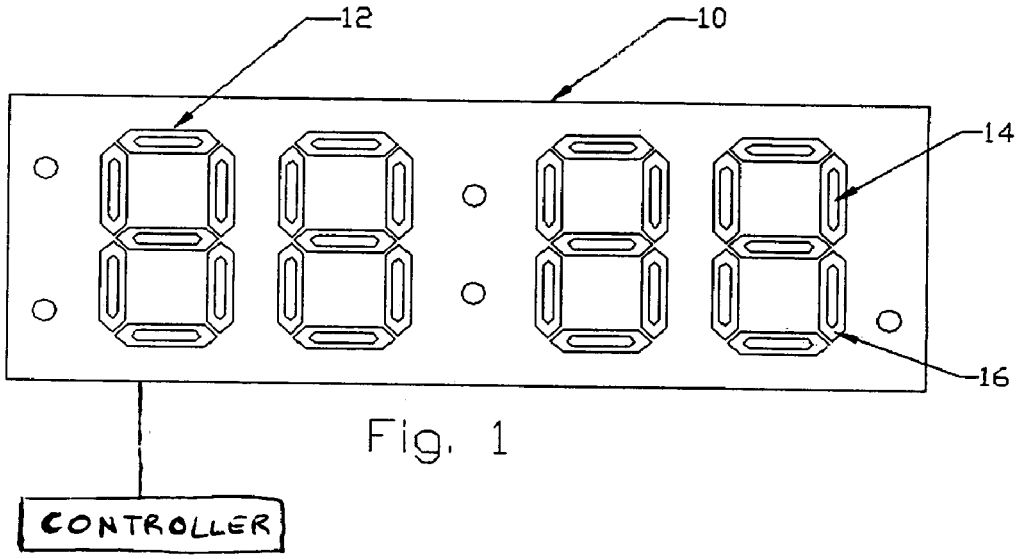
FIG. 1 is a multi-color segmented LED display for a simple LED alarm clock made in accordance with a preferred embodiment of the invention.

In FIG. 1, a multi-color segmented LED display 10 for a simple LED alarm clock includes a plurality of segments 12. Each segment 12 is being driven by a controller on an individual basis, selective illumination of segments 12 on display 10 provides any desired illumination pattern with the illuminated segments. The controller may take any traditional or suitable form. Each segment 12 of the multi-color segmented LED display 10 includes two rooms, room 14 and room 16. Each room includes one or more LEDs with same or different colors to illuminate that room. Room 14 and room 16 of segment 12 are arranged to have different colors when illuminated such that a third color is generated between room 14 and room 16. Thus when illuminated, segment 12 will appear to have three different colors.

Figure 2:
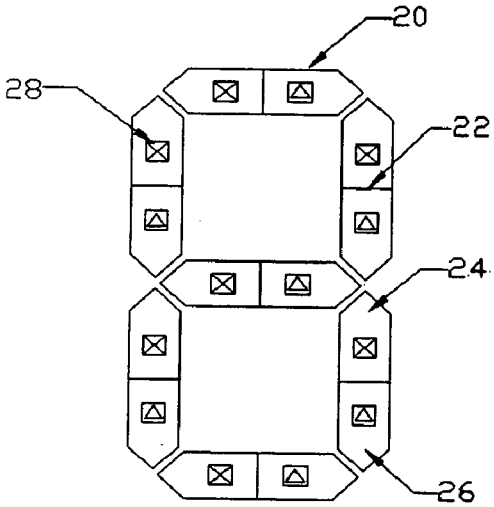
FIG. 2 is one of the multi-color segmented LED display digits with the wall placed in the middle of the segment.

FIG. 2 shows one digit of the multi-color segmented LED display. A wall 22 is placed in the middle of segment 20. Wall 22 separates the segment 20 into two rooms, room 24 and room 26. LED 28 with different colors is placed in room 24 and room 26. Thus when illuminated, segment 20 will appear to have three colors, the first color is from room 24, the second color is from room 26 and the third color is the mixture of color from room 24 and room 26, which locates just above wall 22. Wall 22 can be of any shape and its height can be adjusted to control the width of the mixed color. When wall 22 is adjusted to a certain height, the mixed color will disappear. Thus when wall 22 is adjusted to a certain height, segment 20 will only show two colors.

Figure 3:
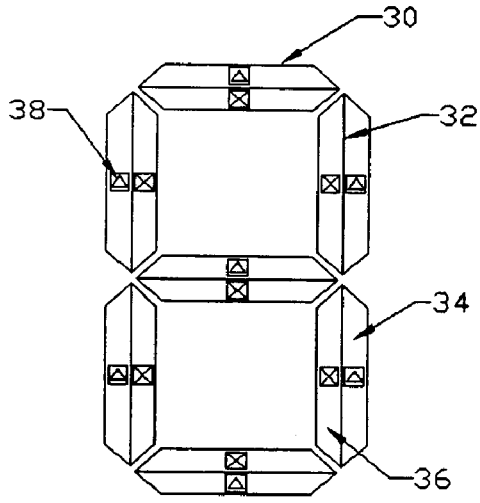
FIG. 3 is one of the multi-color segmented LED display digits with the wall placed in parallel with the segment.

FIG. 3 shows one digit of the multi-color segmented LED display. A wall 32 is placed in parallel with the segment 30. Wall 32 separates the segment 30 into two rooms, room 34 and room 36. LED 38 with different colors is placed in room 34 and room 36. Thus when illuminated, segment 30 will appear to have three colors, the first color is from room 34, the second color is from room 36 and the third color is the mixture of color from room 34 and room 36, which locates just above wall 32. Wall 32 can be of any shape and its height can be adjusted to control the width of the mixed color. When wall 32 is adjusted to a certain height, the mixed color will disappear. Thus when wall 32 is adjusted to a certain height, segment 30 will only show two colors.

Figure 4:
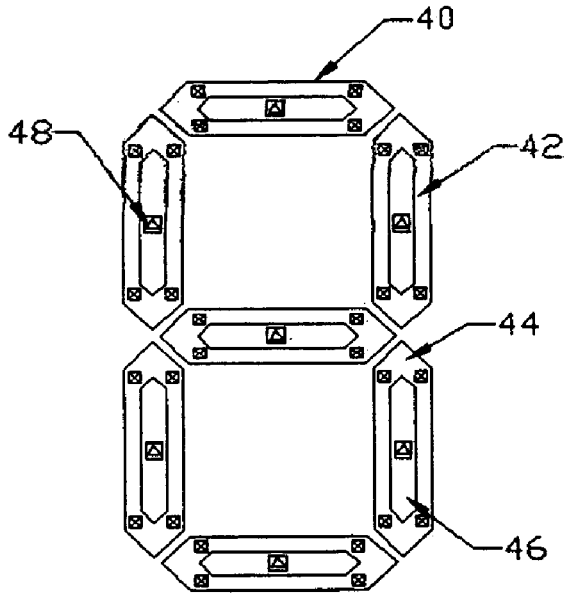
FIG. 4 is one of the multi-color segmented LED display digits with the wall placed in a concentric arrangement with the segment.

FIG. 4 shows one digit of the multi-color segmented LED display. A wall 42 is placed concentric with the segment 40. Wall 42 separates the segment 40 into two rooms, room 44 and room 46. LED 48 with different colors is placed in room 44 and room 46. Thus when illuminated, segment 40 will appear to have three colors, the first color is from room 44, the second color is from room 46 and the third color is the mixture of color from room 44 and room 46, which locates just above wall 42. Wall 42 can be of any shape and its height can be adjusted to control the width of the mixed color. When wall 42 is adjusted to a certain height, the mixed color will disappear. Thus when wall 42 is adjusted to a certain height, segment 40 will only show two colors.

Figure 5:
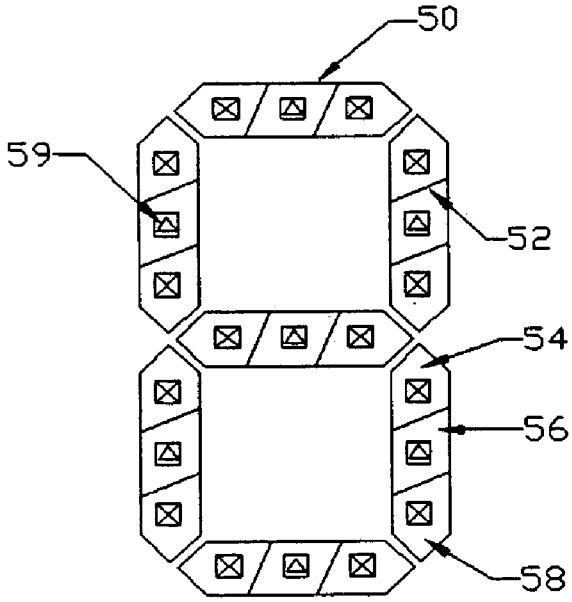
FIG. 5 is one of the multi-color segmented LED display digits with two walls placed inside the segment which separate the segment into three rooms.

FIG. 5 shows one digit of the multi-color segmented LED display. Two walls 52 are placed inside with the segment 50. Wall 52 separates the segment 50 into three rooms, room 54, room 56 and room 58. LED 59 with different colors is placed in room 54, room 56 and room 58. Thus when illuminated, segment 50 will appear to have five colors, the first color is from room 54, the second color is from room 56 and the third color is from room 58. The fourth color is the mixture of color from room 54 and room 56, the fifth color is the mixture of color from room 56 and room 58, which locates just above wall 52. Wall 52 can be of any shape and its height can be adjusted to control the width of the mixed color. When wall 52 is adjusted to certain height, the mixed color will disappear. Thus when wall 52 is adjusted to a certain height, segment 50 will only show three colors.

Figure 6:
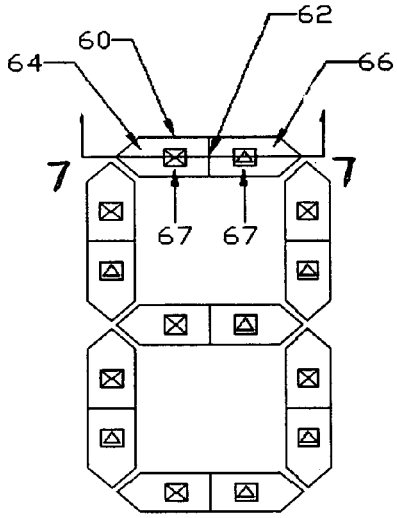
FIG. 6 is one of the multi-color segmented LED display digits with the wall placed in the middle of the segment.
Figure 7:
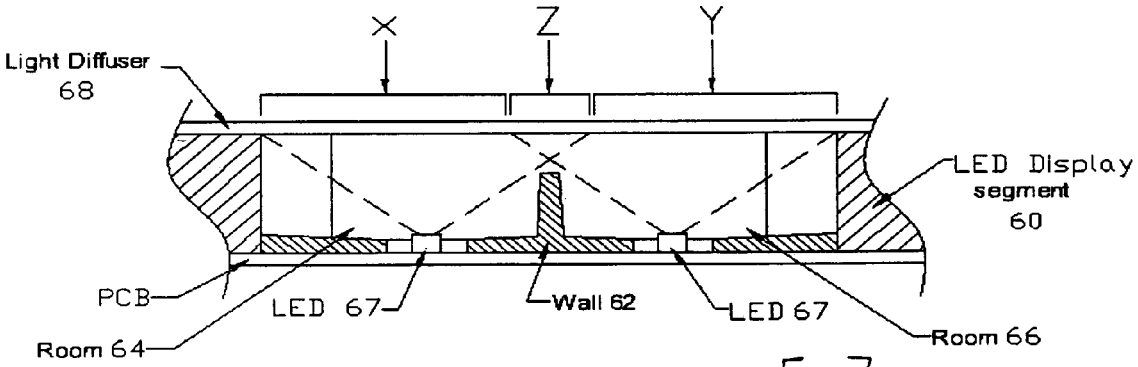
FIG. 7 is a cross sectional view taken along lines 7—7 of FIG. 6.

FIG. 7 is the cross-sectional view of one of the segment of the multi-color segmented LED display taken along line 7—7 of FIG. 6. A light diffuser 68 is placed on top of the LED display and a printed circuit board is used to fix the LEDs 67 and connect them to the control circuitry. A wall 62 is placed in the middle of segment 60. Wall 62 separates the segment 60 into two rooms, room 64 and room 66. LED 67 with different colors is placed in room 64 and room 66. Thus when illuminated, segment 60 will appear to have three colors, the first color is from room 64 (area X), the second color is from room 66 (area Y) and the third color is the mixture of color from room 64 and room 66 (area Z), which locates just above wall 62.

The height of wall 62 can be adjusted to control the width of the mixed color. Increasing the height of wall 62 will decrease the width of the mixed color area Z, but the areas X and Y will increase. When wall 62 height increases to a certain level, with the wall 62 just touching the light diffuser, the mixed color area Z will disappear and the segment 60 will only show two colors.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A multi-color segmented display comprising:

a display including a plurality of segments, at least one of the segments including a plurality of rooms wherein light emitting device arrangements for different colors are placed in adjacent rooms thereby effectively producing a multi-colored segment; and a controller that drives the segments on an individual basis to allow selective illumination of segments on the display to provide the desired illumination pattern with the illuminated segments, wherein the segments are driven to produce a display including the multi-colored segment when displaying the desired illumination pattern;

wherein the multi-colored segment includes at least one wall dividing the segment into the plurality of rooms;

wherein the at least one wall has a height such that a mixed color light effect between the adjacent rooms is produced.

2. The display of claim 1 wherein the display segments are arranged in a form for a digital clock.

3. The display of claim 1 wherein the light emitting devices are light emitting diodes (LED).

4. The display of claim 1 wherein the multi-colored segment includes two rooms.

5. The display of claim 1 wherein the multi-colored segment includes a wall placed concentric within the segment to produce concentric rooms.

6. The display of claim 1 wherein the multi-colored segment includes three rooms, wherein a first room and a second room are adjacent to each other, and the second room is adjacent to a third room.

7. A digital clock comprising:

a housing;

a display secured to the housing, the display including a plurality of segments, at least one of the segments including a plurality of rooms wherein light emitting device arrangements for different colors are placed in adjacent rooms thereby effectively producing a multi-colored segment; and a controller that drives the segments on an individual basis to allow selective illumination of segments on the display to provide the desired illumination pattern with the illuminated segments, wherein the segments are driven to produce a display including the multi-colored segment when displaying the desired illumination pattern;

wherein the multi-colored segment includes at least one wall dividing the segment into the plurality of rooms;

wherein the at least one wall has a height such that a mixed color light effect between the adjacent rooms is produced.

8. The digital clock of claim 7 wherein the light emitting devices are light emitting diodes (LED).

9. The digital clock of claim 7 wherein the multi-colored segment includes two rooms.

10. The digital clock of claim 7 wherein the multi-colored segment includes a wall placed concentric within the segment to produce concentric rooms.

11. The digital clock of claim 7 wherein the multi-colored segment includes three rooms, wherein a first room and a second room are adjacent to each other, and the second room is adjacent to a third room.

* * * * *